US005174570A

United States Patent [19]

Setteducati

[11] Patent Number: 5,174,570

[45] Date of Patent: Dec. 29, 1992

[54] IMAGE TRANSFORMATION PUZZLES

[76] Inventor: Mark Setteducati, 218 E. 17 St., New York, N.Y. 10003

[21] Appl. No.: 677,590

[22] Filed: Mar. 29, 1991

[51] Int. Cl.[5] ..... A63F 9/08

[52] U.S. Cl. ..... 273/155; 273/159; 472/72; 446/487

[58] Field of Search ..... 273/153 R, 155, 153 S, 273/156, 157 R, 159; 446/119, 487, 490; 40/446, 508; 272/8 R, 8 N, 8 D

[56] References Cited

U.S. PATENT DOCUMENTS 1,640,399 8/1927 Druck ..... 273/155
3,201,894 8/1965 Resch ..... 273/155 X
3,561,757 2/1971 Schilling ..... 273/155
4,429,878 2/1984 Asao ..... 273/155
4,738,558 4/1988 Hiromori ..... 273/155 X
4,875,681 10/1989 Ofir ..... 273/155

*Primary Examiner*—V. Millin
*Assistant Examiner*—William M. Pierce
*Attorney, Agent, or Firm*—Robert W. J. Usher

[57] ABSTRACT

An image transformation puzzle comprising a series of elements with image portions on respective front faces thereof successively linked together for incremental translational and rotational movement around a closed loop path between different positions in which image portions of different elements combine to form different composite images. Image portions of successive elements combine in one of the different positions to reduce the total number of composite images in that position producing a vanishing image effect. The elements may be formed as solid profiles of the image portions.

5 Claims, 8 Drawing Sheets

IMAGE TRANSFORMATION PUZZLES

FIELD OF THE INVENTION

The invention relates to puzzles or magicians' tricks which, provide image transformations, in particular, geometric vanishes, and to display devices incorporating such puzzles.

BACKGROUND OF THE INVENTION

In such puzzles, different individual image portions of a first and second series of image portions on respective adjacent edges of first and second pieces of paper, respectively, combine to form different or transformed composite images when the first and second pieces of paper are juxtaposed in different positions. An illusion that one of the prior composite images vanishes is often obtained by the subsequent combination of image portions forming similar, composite images of increased height resulting in an incremental "absorption" of one entire prior composite image into the larger subsequent composite images.

Many attempts have been made over the past century to improve the dramatic effect of such puzzles, as well documented in "Mathematics, Magic and Mystery" c 1956 Dover Publications, by Martin Gardner, particularly pages 114–155; "Games", issue of November/-December 1980, particularly pages 14–18; "Geometrics" c 1939; "Puzzles" c 1986, Plenary Publications International, Washington by Slocum & Batemans; and, U.S. Pat. No. 563,778 to Lloyd.

The Lloyd patent discloses image carrying elements comprising a disk rotativey mounted on a backing sheet and first and second series of individual image portions located at the same circumferencial spacings extending to the circumference of the disk and the adjacent portions of the backing sheet, respectively. Incremental rotation of the disk brings different individual image portions of the first and second series into combinative alignment to form apparently identical composite images but which are, in fact, of increased radial size resulting in the "absorption" of an entire original composite image providing the illusion that an entire image has disappeared.

However, a disadvantage of the simpler prior versions in which only two image carrying elements are moved in edge-to-edge relation is that only a very limited illusory effect is provided, as dramatically different images cannot be formed. The more sophisticated and dramatic of the prior versions, however, often require rearrangement by transposition, (change in sequential order of presentation), of the elements, which involves relatively complex movements in opposite directions and at least three loose pieces. Such transpositions cannot be effected sufficiently quickly to provide a dramatic effect before an audience, are unsuited for mechanical application and for a changing mobile display.

Objects of the present invention include the provision of a display device, trick or puzzle of the image transformation, preferably, geometric vanish, kind in which more complex composite images can be transformed without requiring transpositions of loose pieces, thereby enabling the image carrier elements to be linked for simultaneous movement to effect transformation, as by the pass of a magician's hand.

According to one aspect of the invention, elements carrying image portions are located for translational and pivotal movement along an endless loop path, incrementally shifting all the elements together in the same sense around such path without a change in sequence bringing together different image portions to produce different composite images.

More specifically, the invention provides an image transformation display device comprising a series of elements with image portions on respective faces thereof forming an image plane and means locating the elements for incremental translation and rotational movement together around a closed loop path in the image plane between different positions in which image portions of different elements combine to form different composite images.

Preferably, different numbers of image portions are combined in the different positions to provide different numbers of composite images.

Desirably, image portions of successive elements combine in one of the different positions to reduce the total number of composite images in that position to less than the number of composite images in another of the different positions.

In the first position, individual image portions of the elements of different rows combine to form composite images and, in the second position, at least one image portion of one row combines both with an image portion of the other row and an image portion of an adjacent element in the same row to form a composite image, thereby to reduce the number of composite images.

According to another aspect of the invention, there is provided an image transformation puzzle comprising four moveable elements carrying respective image portions on respective front faces and arranged closed together as upper and lower rows with the first and the last elements of the upper row being of equal length to the last and the first element of the lower row, pivot means linking adjacent inner corners of successive elements together to form a ring, individual image portions in the upper row combining with individual image portions in the lower row to provide a series of composite images, the elements being moveable apart and together in the plane of the front face in the same rotational sense, from a first closed position, through a transitional open ring position, to a second closed position with the elements incrementally moved to a second position with the first elements of the upper row and the last elements of the lower row being transferred to become last and first elements in the lower and upper rows, respectively, and the first and last elements of the lower and upper rows respectively transferred to become last and first elements of the lower and upper rows respectively, bringing together different image portions to produce different composite images.

Preferably, the last elements of the upper row and the first elements of the lower row are of substantially greater length than the first elements of the upper row and the last elements of the lower row forming a bar or wand.

In one embodiment, each element has at least an outer profile defining a solid image portion.

According to a different aspect of the invention, the puzzle comprises an angled strip consisting of first and second obliquely extending arm portions, respective first arm portions carrying image portions at least on reflex faces and respective second arm portions extending in parallel relation with elongate lower edges linked together by the hinge means. Preferably, image portions are provided on three differently directed faces.

According to a further aspect of the invention, there is provided a puzzle of the image transformation type comprising four square elements having image forming portions on front faces defining an image plane and means pivotally linking the elements together extending in end-to-end relation at successive adjacent corners for relative pivotal movement about axes extending perpendicularly to the image plane with rear faces of the elements forming a ring, open in a transitional position by movement apart of the elements, whereby rotational and translational shift of the elements in alternative, opposite directions from the transitional position closes the ring bringing, alternatively, different pairs of adjacent sides of one element together into engagement with different pairs of adjacent sides of another element to which it is directly linked thereby, alternatively, bringing different image portions of such elements into combination to form different composite images.

According to an additional aspect of the invention, there is provided an image transformation puzzle comprising a flexible strip carrying different individual image forming portions in spaced apart relation along one side thereof which strip can be folded on itself at different selected locations to bring selected, different image forming portions into juxtaposition with combination thereof to form selected different composite images.

The strip can be folded on itself at a first location to bring only selected image forming portions at longitudinally spaced apart locations into combination by juxtaposition to form composite images and, at a second location, to bring both selected different image forming portions at longitudinally spaced apart locations and successive adjacent image portions into combination to form composite images, thereby reducing the total number of composite images.

The invention also provides a magicians' trick or puzzle comprising a flexible strip carrying different individual image forming portions in spaced apart relation along one side thereof which strip can be folded on itself at different selected locations to bring selected, different image forming portions into juxtaposition with combination thereof to form selected different composite images; a series of composite image carriers from which a spectator can preselect a composite image whereby the selected composite image can be made to, at least one of, appear and disappear, according to the location of the folding of the strip, as desired by the magician.

The strip can be folded on itself at a first location to bring only selected image forming portions at longitudinally spaced apart locations into combination by juxtaposition to form composite images and, at a second location, to bring both selected different image forming portions at longitudinally spaced apart locations and successive adjacent image portions into combination to form composite images, thereby reducing the total number of composite images.

BRIEF DESCRIPTION OF THE DRAWINGS

Specific embodiments of the invention will now be described by way of example only with reference to the accompanying drawings in which:

FIG. 1(*b*) is a similar view of the first embodiment in an transitional state of image transformation with the elements moved apart, opening the ring;

FIG. 1(*c*) is a similar view of the first embodiment with the elements closed together in a second arrangement to reform the bar or wand completing the transformation of composite images;

FIGS. 1(*d*) and (*e*) are similar views to FIGS. 1 (*a*) and (*b*) of the rear of the bar or wand in the first and rearranged positions, respectively;

FIG. 2(*b*) is a similar view of the second embodiment in an transitional state;

FIG. 2(*c*) is a similar view of the second embodiment with the elements rearranged, reforming the display device with transformed composite images.

FIG. 3(*b*) is a similar view of the third embodiment with the elements moved apart in a transitional state;

FIG. 3(*c*) is a similar view of the third embodiment with the elements rearranged and closed together reforming the display with the entire composite image transformed into a single new composite image;

FIGS. 4(*d*),(*e*) and (*f*) are views corresponding to those of FIGS. 4(*a*),(*b*) and (*c*), respectively, of the rear of the fourth embodiment; and, FIGS. 5(*a*)-(*c*) are perspective views of a fifth embodiment showing linked cube elements in first, transitional, and second, rearranged positions, respectively, with transformation of the composite image; and, FIGS. 6(*a*)-(*c*) are perspective views of a sixth embodiment showing linked rectangular block form elements in first, transitional, and second, rearranged positions, respectively, with transformation of the composite images formed by opposite outer major faces thereof.

Figure 1A:
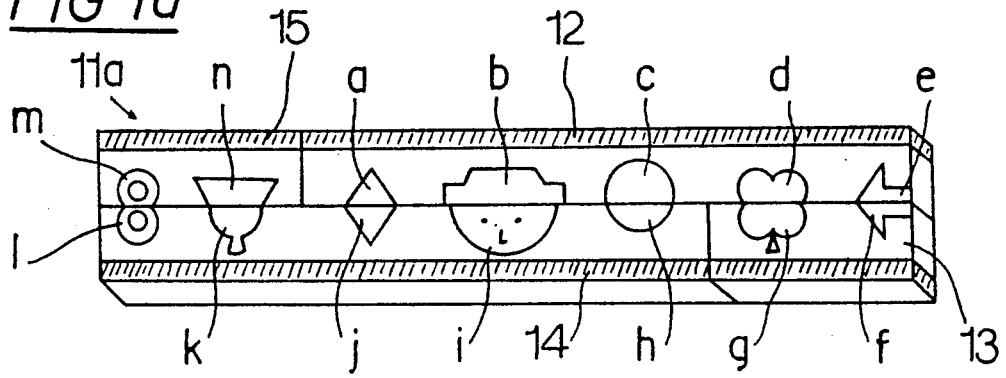
FIG. 1(*a*) is a perspective view of a linked ring of image portion carrying elements closed together in a first arrangement forming a display or magician's bar or wand showing a first series of composite images or symbols.
Figure 1B:
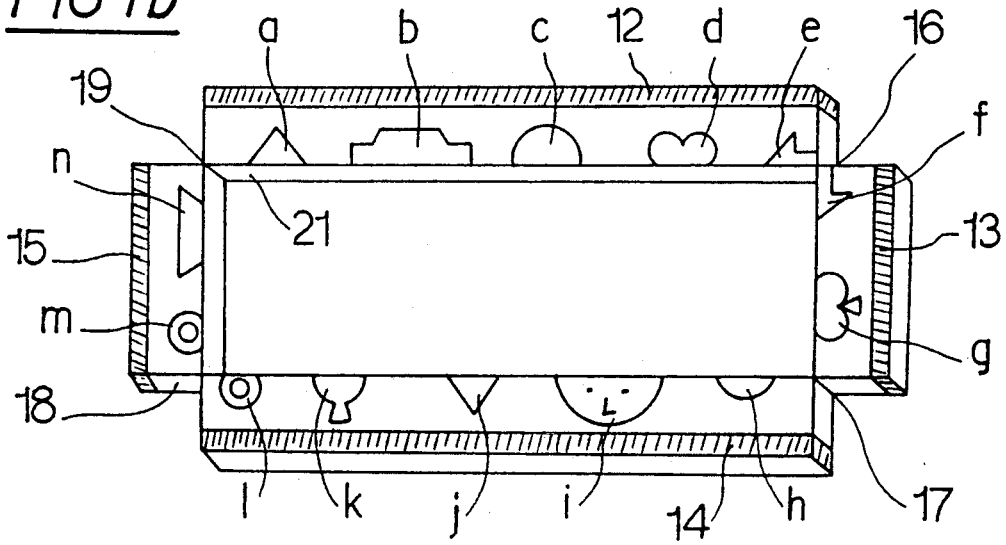
Figure 1C:
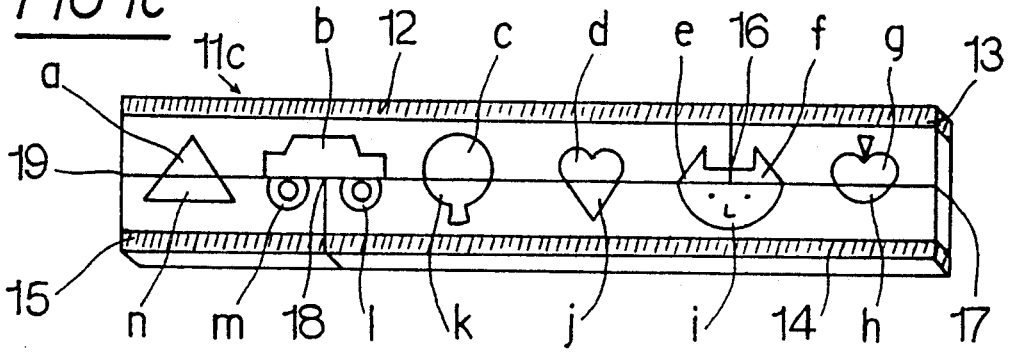
Figure 1D:
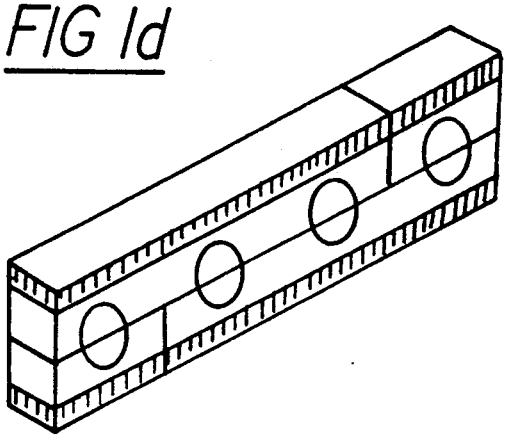
Figure 1E:
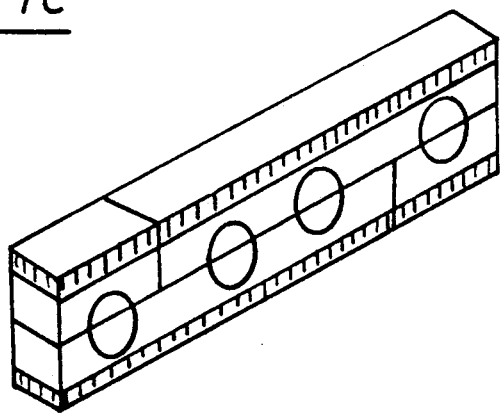

In the first example shown in FIGS. 1(*a*)-(*c*), the display or magician's bar or wand 11(*a*) comprises four image portion or indicia carrying elements 12–15, respectively, formed by rectangular blocks. As most clearly seen in FIG. 1(*b*), inner adjacent corners of successive elements are hingedly connected together at 16–19 by adhesive tape 21 extending across inner and, preferably, outer adjacent faces of the elements to form a linked rectangular ring structure. Horizontally extending, opposite upper and lower blocks 12 and 14, respectively, are longer than vertically extending side blocks 13 and 15, respectively, the longer and shorter blocks being arranged alternately around the ring.

Each block carries on a front face 25, a plurality of image forming portions or image or indicia precursors an extending to adjacent inner edges of such faces.

The horizontal blocks can be displaced in alternative longitudinal directions, each in the same rotational sense from the transitional position of FIG. 1(*b*), while urged together to close the linked ring, with both pivotal and translational movement of the end blocks bringing inner faces of the blocks together as two rows, the smaller blocks 15 and 13, occupying, alternatively, either row to form either bars 11(*a*) or 11(*c*) shown in FIGS. 1(*a*) and 1(*c*), respectively, in which the individual image portions on different blocks combine with different image portions of other blocks to form different composite images providing the transformation effect.

For example, in the first combination, shown in FIG. 1(*a*), in which blocks 15 and 12 form first and last elements of an upper row and blocks 13 and 14 form last and first elements of a lower row, respective pairs of image forming portions a–n combine as follows: 1 and m form a FIG. 8; k and n, a cup; j and a, a diamond; a and b, a capped visage; h and c, a circle or moon; g and d, a club; e and g, an arrow.

To transform the composite images to obtain the second combination of bar 11(*c*) of FIG. 1(*c*) from the transitional position of FIG. 1(*b*), the longer blocks 12 and 14 are shifted longitudinally in a direction opposite to the former direction and in the same rotational sense as each other along the closed loop path defined by the ring with corresponding rotational and translational movement of the end blocks 13 and 15 in such opposite direction so that the blocks 12 and 13 then form the first and second (or last) blocks of the upper row, and blocks 14 and 15 form the last and first blocks of the lower row.

In this arrangement, the composite images are transformed by the different combination of image portions, n and a combining to form a triangle; l, m and b, an automobile; k and c, a paddle; j and d, a heart; i, e and f, a cat's face; h and g, an apple.

It should be noted that the seven composite images of the first arrangement of FIG. 1(*a*) have been transformed to provide only six composite images in the arrangement shown in FIG. 1(*c*) as two image portions m and l have combined with b to form the single composite image of an automobile and two image portions e and f have combined with i to form the cat's face. Thus, this example provides the advantage of a lateral as well as a vertical combination of images, that is, combination in two orthogonal directions of image portions on both successive and alternate, or opposite elements, to obtain the transformation.

This example also enables performance of an amazing magician's trick or illusion. The bar 11(*a*) or 11(*c*) is displayed to a spectator who is asked to select and remember one image. A magician's handkerchief is then placed over the bar with the lower element 14 supported by one hand and the opposite, upper element 12 held by the other hand enabling the bar to be rapidly opened to the transitional position, the elements incrementally shifted, and closed to the rearrangement of FIG. 1(*c*) transforming the composite images. It will be appreciated that this can be carried out very quickly in a single smooth sweeping pass of the hand and handkerchief.

The magician will say that he was able to sense the chosen image and able to make it disappear. The fact that all images change will not be noticed by the average spectator who will assume that only the image that he selected is missing and will be astonished by the trick.

The impression that the bar remains unaltered is enhanced by the provision of an unchanging border on upper and lower blocks, preferably, oblique line shading, as shown, while the rear face of the bar may carry composite images formed as circles which also appear to remain unchanged after the rearrangement , as shown in FIGS. 1(*d*) and (*e*).

Figure 2A:
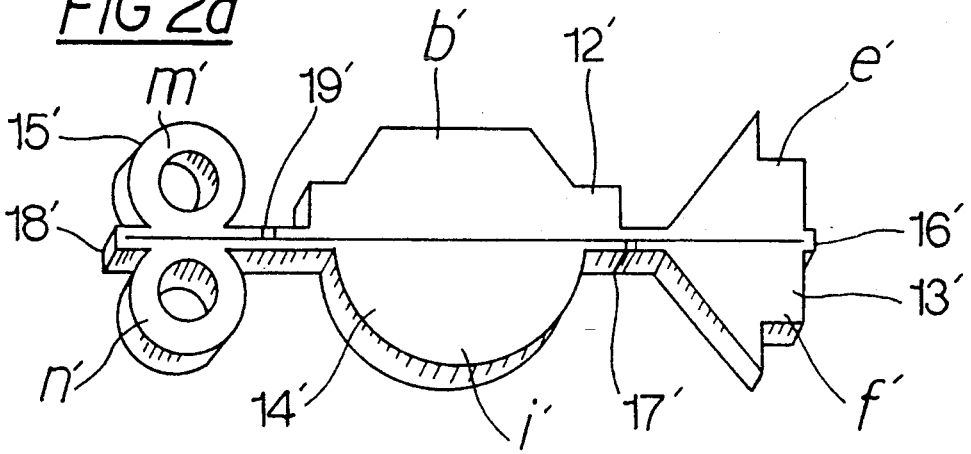
FIG. 2(*a*) is a perspective view of a second embodiment of display device with the elements arranged to form a first series of composite images.
Figure 2B:
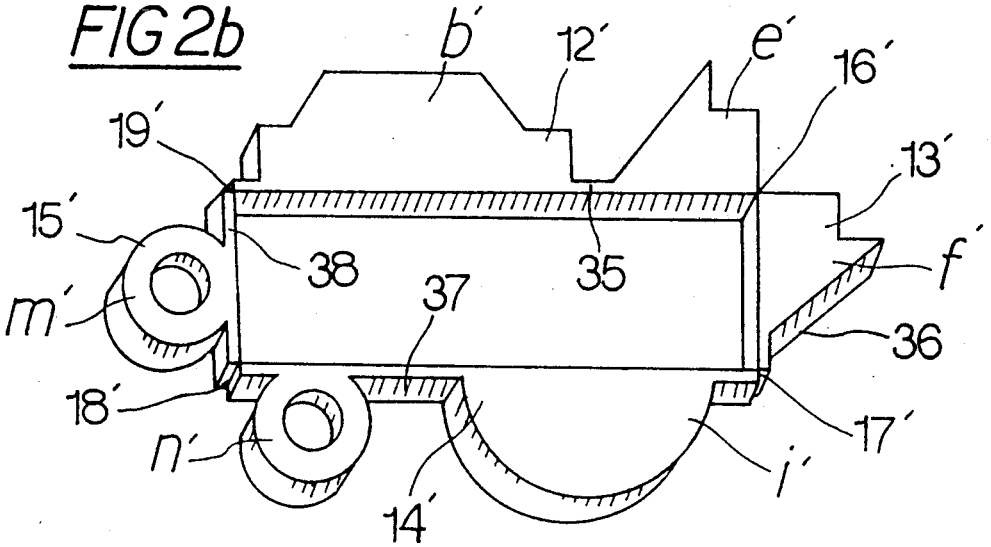
Figure 2C:
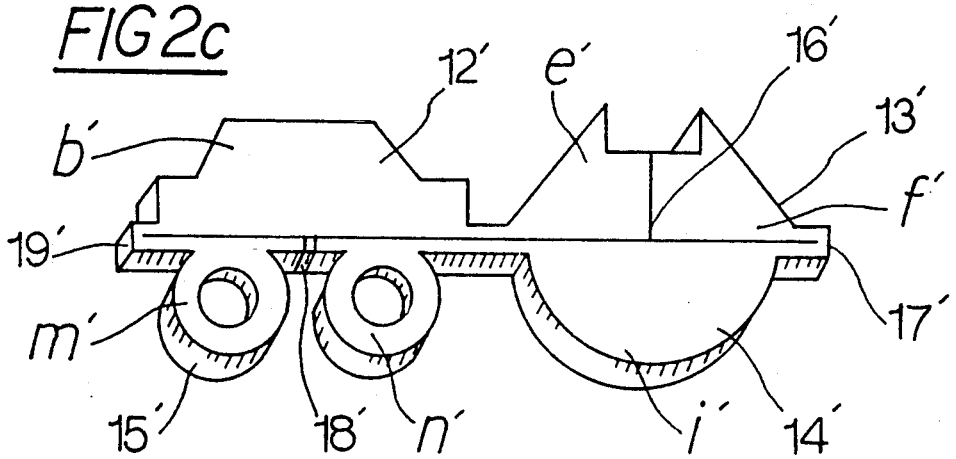

In the example of FIG. 2(*a*)–(*c*), the block elements themselves 12' to 15' are formed as solid shapes providing respective image portions b', e', f', i', n', and m', and have strip-like bases 35–38 joined by hinged portions 16' to 19'.

The transformation can again be effected with a flourishing part of the hand and handkerchief.

This version may be particularly suitable as an advertising display or childrens' novelty puzzle.

The device need not be endless but, for example could be separated or discontinuous at the pivot point 16' to provide a single, long, flexible strip foldable on itself at different longitudinally spaced locations to bring selected image portions into combination to provide different selected composite images. Successive, adjacent image portions can be combined as well as image portions which are spaced apart longitudinally of the strip and brought into abutment as a result of folding the strip to reduce the total number of composite images, if desired.

A spectator is shown the strip in open form, not recognising any (composite) image and then asked to select one image from a group of possible composite images shown, for example, on a card or as a collection of solid objects. The strip could then be folded to bring different image portions together to make a selected image(s), (or image portion(s)), appear or disappear, as desired, to produce different magical effects.

In some examples, the strip can be repeatedly folded to provide several layers having image portions combining to form different composite images.

In another version, the strip can be endless or a single , continuous length with the different image portions brought into juxtaposition by rolling the folded strip shifting the image portions on respective sides of the fold longitudinally relative to each other, that is shifting image portions on one side of the strip longitudinally relative to image portions on the other side of the strip.

In one version, the selection could be made at random from a pack of cards carrying the possible images or by rolling dice to select a numbered image.

Figure 3A:
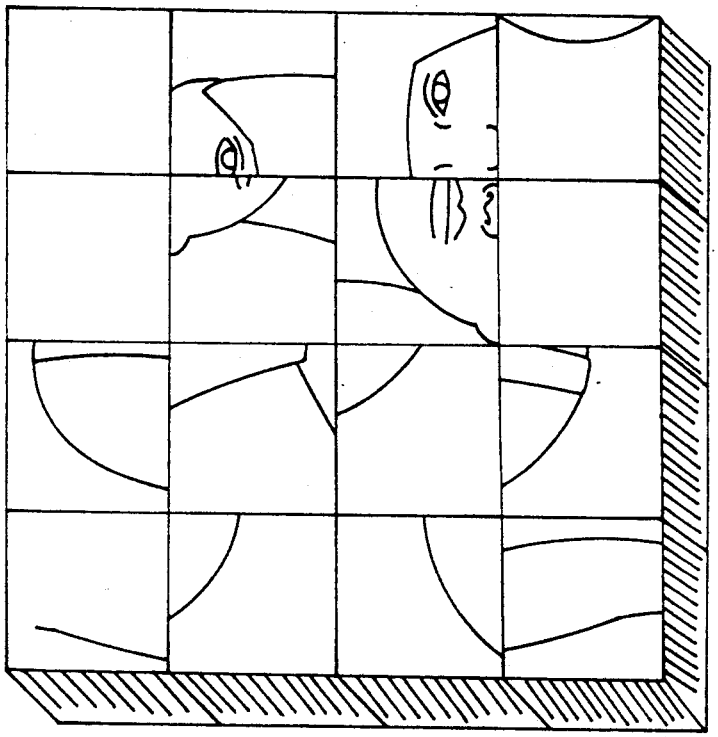
FIG. 3(*a*) is a plan view of a third embodiment of display with the elements arranged to form a first composite image.
Figure 3C:
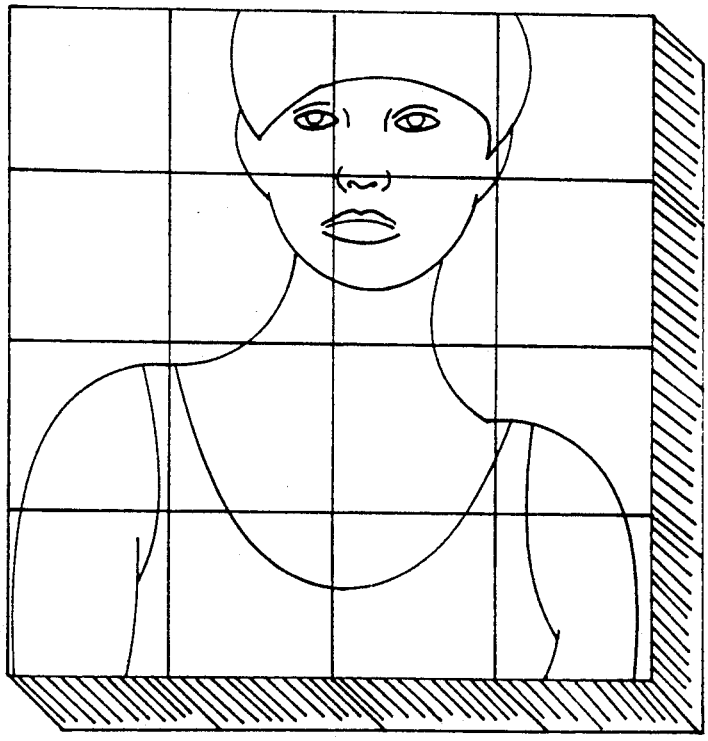
Figure 3B:
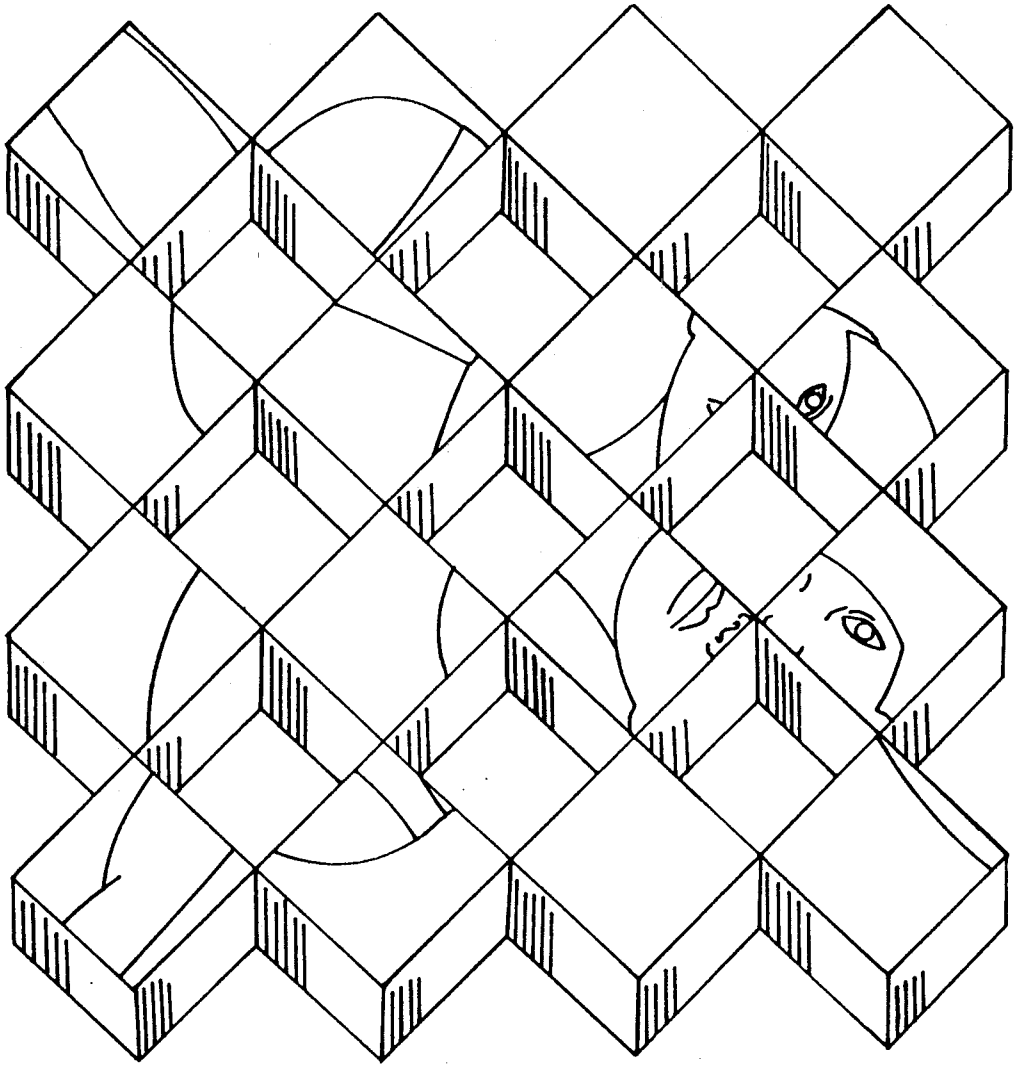
Figure 4A:
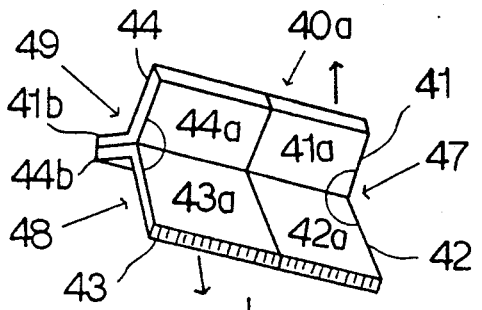
FIGS. 4(*a*),(*b*) and (*c*) are perspective views of the front of a fourth embodiment showing, respectively, the elements closed together in first composite image forming positions, moved apart in a transitional state, and rearranged, closed together after complete transformation in second position composite image forming positions with transformation of the composite images.
Figure 4B:
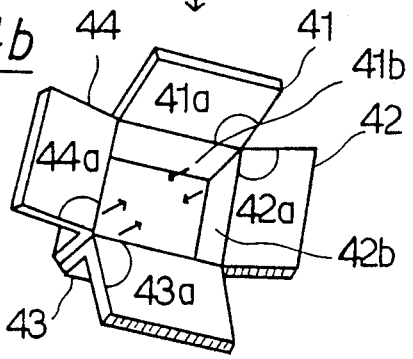
Figure 4C:
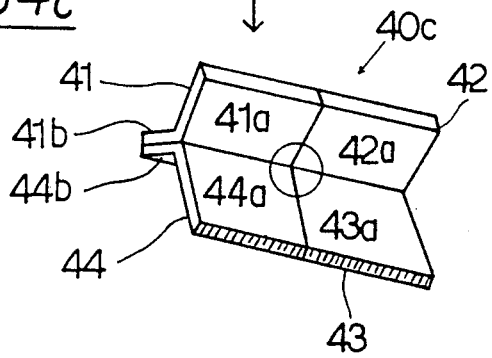
Figure 4D:
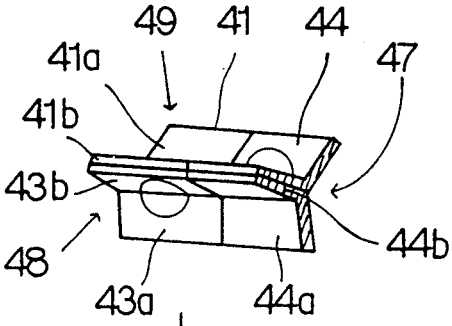
Figure 4E:
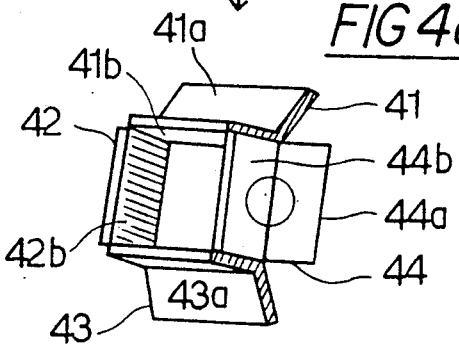
Figure 4F:
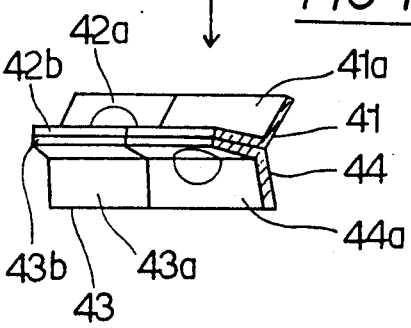

In the example of FIGS. 3(*a*)–(*c*) two sets of four cubic elements, each carrying image portions on a front face, are pivotally connected at adjacent corners to provide a series of linked ring structures, pivotal rotational and translational movements of the elements in opposite directions through the open ring position, again produced by a simple hand pass, bringing different image portions into combination, transforming a disjointed or fragmented image into a stunning portrait of a beautiful young woman.

The combination of translational and rotational movement of the individual image carriers or elements about axes perpendicular to the image plane enables image portions in orthogonal directions to be simultaneously combined, thereby increasing the versatility and dramatic effect of the transformation.

Clearly such structure can be made to any size adding pairs of square face elements carried on cubes pivotally linked at their corners.

In the example of FIGS. 4(*a*)–(*f*) each element 41–44, respectively is of identical shape and formed as an angled strip having arms 41(*a*), (*b*)–44(*a*),(*b*), respectively, that can be closed together to provide alternative Y-profile bars 40(*a*) and 40(*c*) with potentially three exposed image carrying faces 47, 48 and 49. Arm portions 41(*b*)-44(*b*) of each strip 41-44, respectively, extend in parallel planes and are pivotally linked at adjacent edges to provide the linked ring structure while the main (vanishing) composite image is formed on the faces of the obliquely extending portions 41(*a*)-44(*a*) forming face 47, with the other two faces 48 and 49 shifting positions from top to bottom and vice versa.

This affords the advantage of a multi-dimensional display which can be free-standing.

Figure 5A:
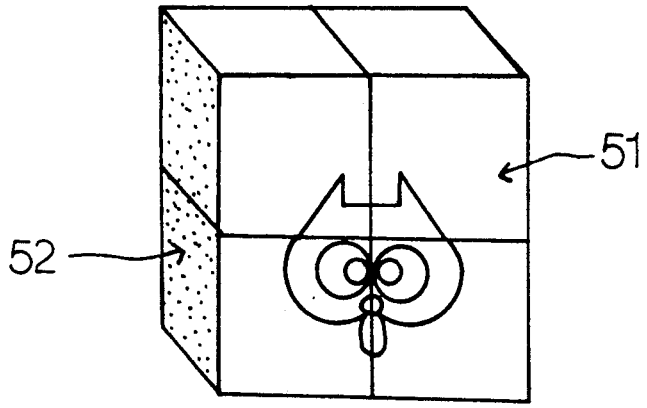
Figure 5B:
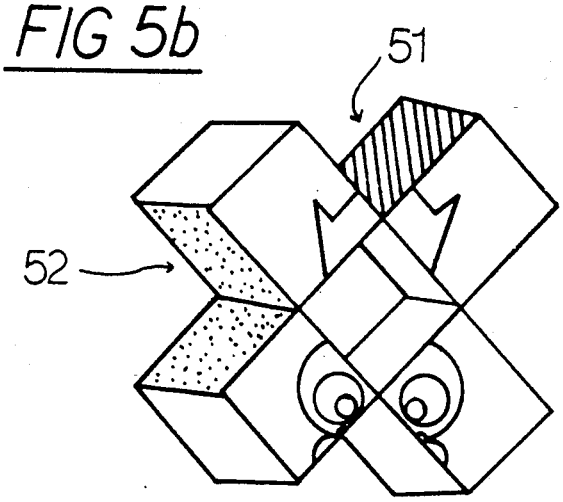
Figure 5C:
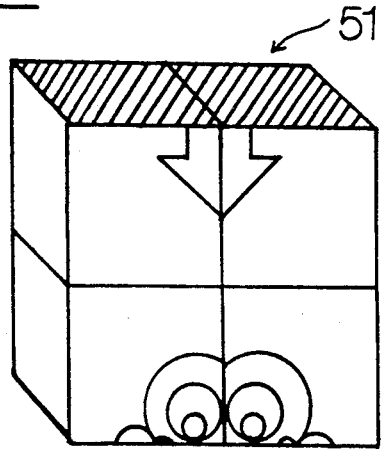

As shown in FIG. 5(*a*)-(*c*), four linked cubic elements can provide a face 51 with a geometric vanish and alternatively concealed and revealed side faces 52 and 53.

In the position shown in FIG. 5(*a*), side face 52 is exposed while precursor of face 53 is concealed. Subsequent movement through the expanded ring position with lateral and rotational shift and closure together produces the condition of FIG. 5(*c*) in which side face 53 is exposed while side face 52 is now hidden.

Figure 6A:
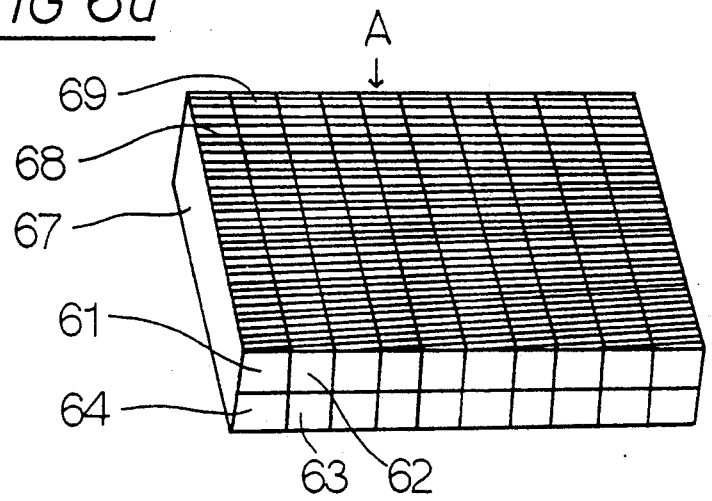
Figure 6B:
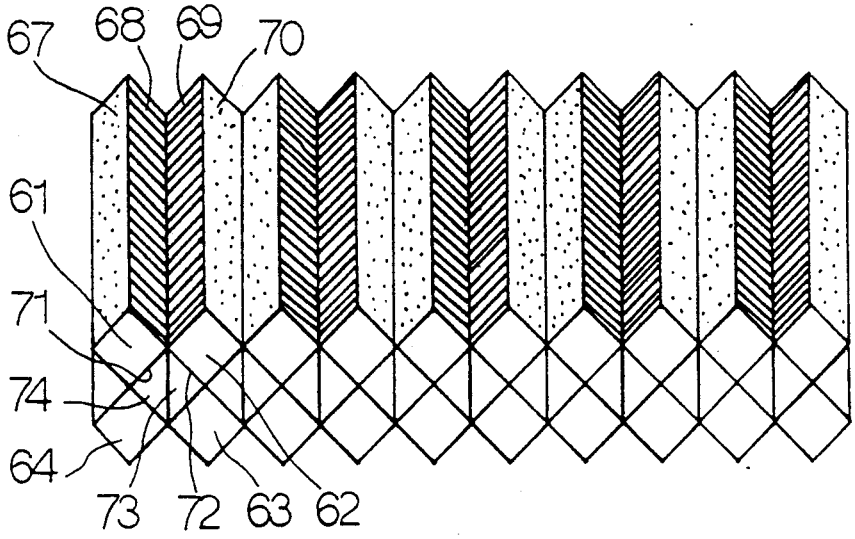
Figure 6C:
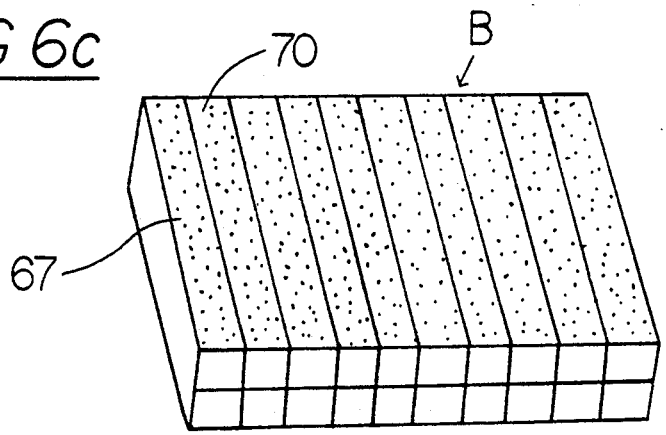

In the embodiment of FIGS. 6 (*a*)-(*c*), a display, trick or puzzle comprises sets of four elongate elements 61-64 of square cross-section, each element having two different image portions carried by respective outer, adjacent elongate faces 67-70, respectively, (only top shown). Longitudinal corner edges of adjacent elements are pivotally linked together as a ring bounded by one adjacent inner elongate face 71-74, respectively, of each element 61-64. The ring is open in a transitional position shown in FIG. 6(*b*) with the elements moved apart. Rotational and translational shift of the elements in alternative opposite directions from the transitional position brings different pairs of inner, elongate faces 71,72;73,74 or 71,74;72,73, respectively, of respective elements into abutment, closing the ring, and different image carrying faces of adjacent elements 68,69 or 67,70, respectively, into coplanar relation so that different image portions of such faces combine to form different composite images A and B, respectively, of FIGS. 6(*a*) and (*c*), respectively.

It will appreciated that although, as would be most advantageous for many magician applications the individual elements are pivotally linked together, the elements can also be linked by a band of elastic passing therethrough, a wire frame or backing plate to provide a closed loop path to enable the transformations necessary for transformation for the composite image.

In some applications, the blocks may be hollow, shell-like structures and their inner faces, in particular, need not be constituted by continuous walls, providing channel - section structures pivotally linked together at free ends of channel walls so the mouths of the channels open inwards, towards each other.

I claim:

1. An image transformation puzzle of the geometric vanish type comprising four elongate elements having respective front faces carrying indicia at longitudinally spaced apart intervals and having respective needs pivotally linked together to form a parallelogram foldable through 80° between two orthogonal positions in each of which the elements are closed together so that he indicia form first and second rows with indicia of the first row being in combinative juxtaposition with indicia of the second row together forming a number of recognizable symbols and located at longitudinally spaced apart intervals, folding to a first closed position bringing individual indicia of the first row into combinative juxtaposition only with respective, individual indicia of the second row to form a number of said recognizable symbols each formed by a combination of only one indicia from each row, folding to the other closed position transposing individual indicia at one end of the first row and individual indicia at an end of the second row opposite the one end from the first row to the second row and from the second rows to the first row, respectively, bringing the transposed indicia, respectively into additional combinative juxtaposition with an adjacent, previously endmost, indicia of the second and first rows into which they have been transposed, respectively, so that the transposed indicia in combinative juxtaposition in the same row combine also with respective indicia of the other row to form the recognizable symbols providing a total number of recognizable symbols less in number by one than in the first position thereby producing the illusion of a vanishing image.

2. A puzzle according to claim 1 wherein a last element of the first and a first element of the second row are of substantially greater length than a first element of the first row and a last element of the second row.

3. A puzzle according to claim 2 wherein the indicia on each element are formed by solid shapes interconnected by thin strips.

4. A puzzle according to claim 1 in which the number of recognizable symbols is reduced from three to two by folding between the first and second, closed positions.

5. A puzzle according to claim 1 in which the number of recognizable symbols is reduced from seven to six by folding between the first and second, closed, positions.

* * * * *

UNITED STATES PATENT AND TRADEMARK OFFICE

CERTIFICATE OF CORRECTION

PATENT NO. : 5,174,570

DATED : December 29, 1992

INVENTOR(S) : Settifucati, Mark

It is certified that error appears in the above-identified patent and that said Letters Patent is hereby corrected as shown below:

Col 8, line 7, "needs" should read --ends--

Col 8, line 9 "80" should read --180°--

Signed and Sealed this

Ninth Day of November, 1993

Bruce Lehman

*Attest:*

BRUCE LEHMAN

*Attesting Officer*

*Commissioner of Patents and Trademarks*